United States Patent [19]

Tokuno

[11] 4,232,859

[45] Nov. 11, 1980

[54] BLANK FEEDING APPARATUS

[75] Inventor: Masateru Tokuno, Nishinomiya, Japan

[73] Assignee: Rengo Kabushiki Kaisha (Rengo Co., Ltd.), Osaka, Japan

[21] Appl. No.: 5,016

[22] Filed: Jan. 19, 1979

[30] Foreign Application Priority Data

Jan. 27, 1978 [JP] Japan ..... 53/9719
Feb. 24, 1978 [JP] Japan ..... 53/21340

[51] Int. Cl.[3] ..... B65H 3/24

[52] U.S. Cl. ..... 271/35; 271/10; 271/270; 271/271; 318/39; 414/130

[58] Field of Search ..... 271/35, 10, 11, 12, 271/13, 15, 16, 17, 34, 271, 270, 139, 114; 414/130, 131, 124; 318/39, 571; 198/571, 575, 577

[56] References Cited

U.S. PATENT DOCUMENTS

| | | | |
|---|---|---|---|
| 2,110,980 | 3/1938 | Swift | 271/35 |
| 2,749,118 | 6/1956 | Kerr et al. | 271/12 |
| 3,981,494 | 9/1976 | Prestegaard | 271/10 |

*Primary Examiner*—Bruce H. Stoner, Jr.
*Attorney, Agent, or Firm*—Wenderoth, Lind & Ponack

[57] ABSTRACT

A blank feeding apparatus for feeding blanks one after another from a stack of blanks to the next processing rolls. Blanks are pushed by kickers attached to an endless conveyor. The motor for driving the conveyor is electronically controlled so that one cycle of kicker operation will be completed while the processing rolls make a full rotation, said one cycle including the acceleration tuned-run and deceleration steps.

1 Claim, 7 Drawing Figures

BLANK FEEDING APPARATUS

The present invention relates to apparatus for feeding blanks of corrugated paperboard or the like one after another from a stack of blanks to rolls of a printer or the like.

In a conventional apparatus for feeding blanks one after another to the next processing rolls of an apparatus such as a printer/slotter, a folder/gluer, or a rotary die cutter, the blank at the bottom of a stack of blanks is pushed forward by a kicker coupled with a crank device. The problem has been that the use of a kicker having a sufficient stroke for the length of blanks makes the entire apparatus bulky in size and requires a large floor space. In order to make the apparatus compact, it has been necessary to provide a pair of feed rolls to pull the blanks out of the stack. However, these feed rolls cause another problem in that they engage the blanks with a force strong enough to deform or crust the corrugated layer of the paperboard, thus causing a considerable decrease in its strength.

An object of this invention is to provide a blank feeding apparatus which obviates the above-described drawbacks by eliminating the feed rolls.

Other objects and advantages of this invention will become apparent from the following description taken with reference to the accompanying drawings, in which.

Figure 5A:
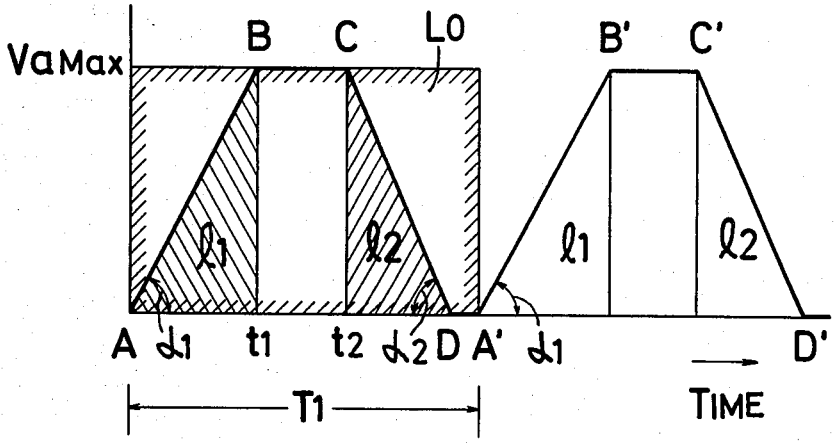
Figure 5B:
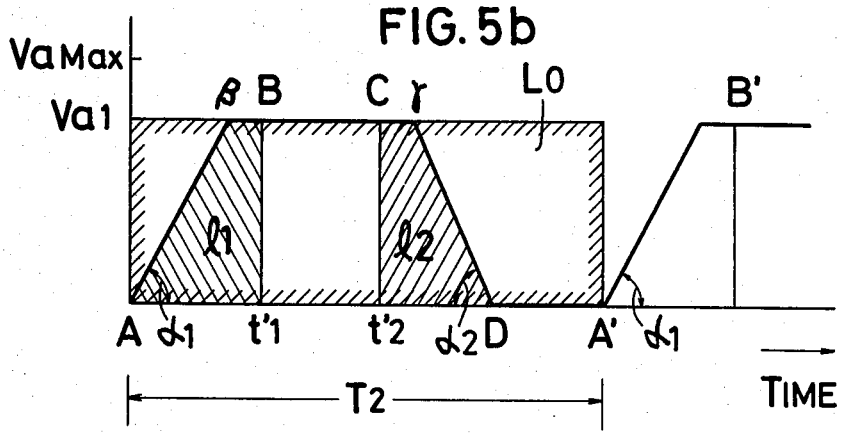
Figure 6:
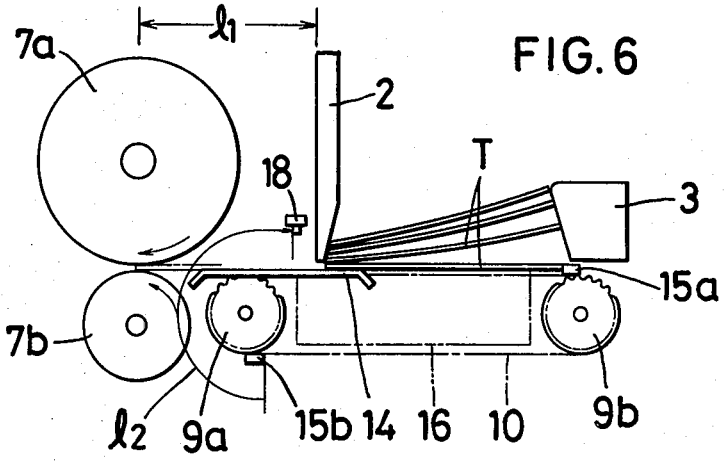

FIGS. 5*a* and 5*b* are speed-time diagrams explaining how the kicker runs; and FIG. 6 is a schematic view of the arrangement for shorter blanks.

Figure 1:
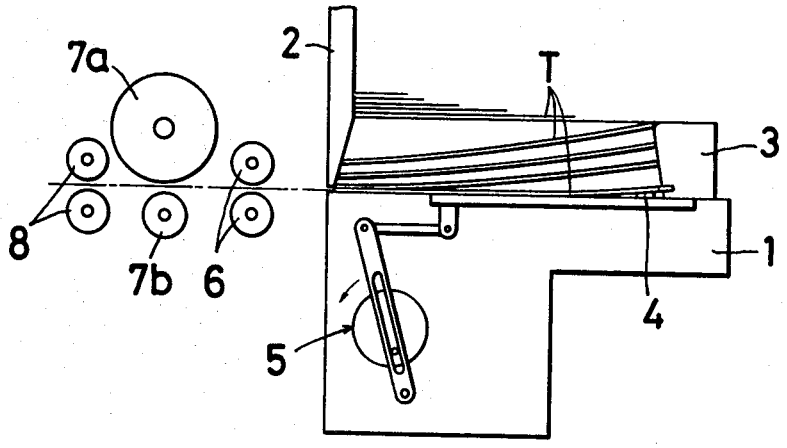
FIG. 1 PRIOR ART
FIG. 1 is a schematic view of a prior art blank feeding apparatus.

Referring to FIG. 1 illustrating the prior art blank feeding apparatus, blanks are stacked on a table 1 between a front guide 2 and a back guide 3. They are pushed forward one after another by means of a kicker 4 coupled with a crank device 5. They are then fed by a pair of feed rolls 6 into a pair of processing rolls including e.g. a printing roll 7*a* and a press roll 7*b* which rotate at the same speed as the feed rolls. The processing roll is followed by a pair of nip rolls 8 which feed the blanks to the next processing station. This prior art apparatus has the above-described drawbacks that the feed rolls deform or crush the corrugated layer of paperboard blanks.

Figure 2:
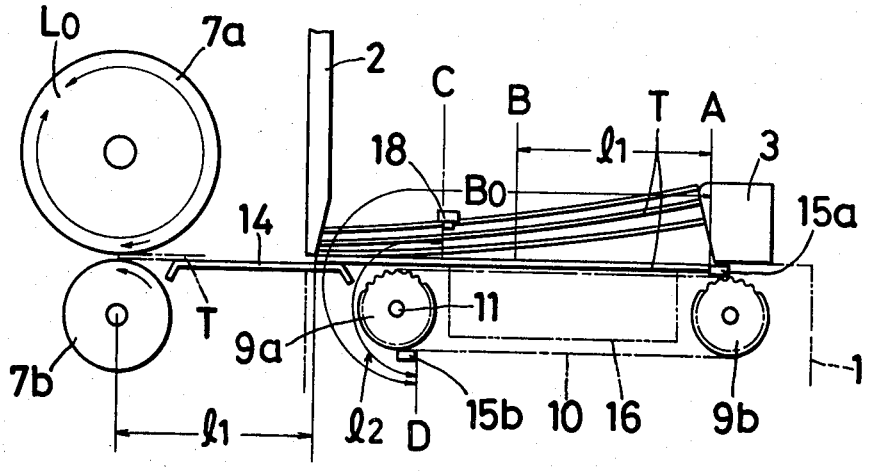
FIG. 2 is a similar view of an apparatus embodying this invention.
Figure 3:
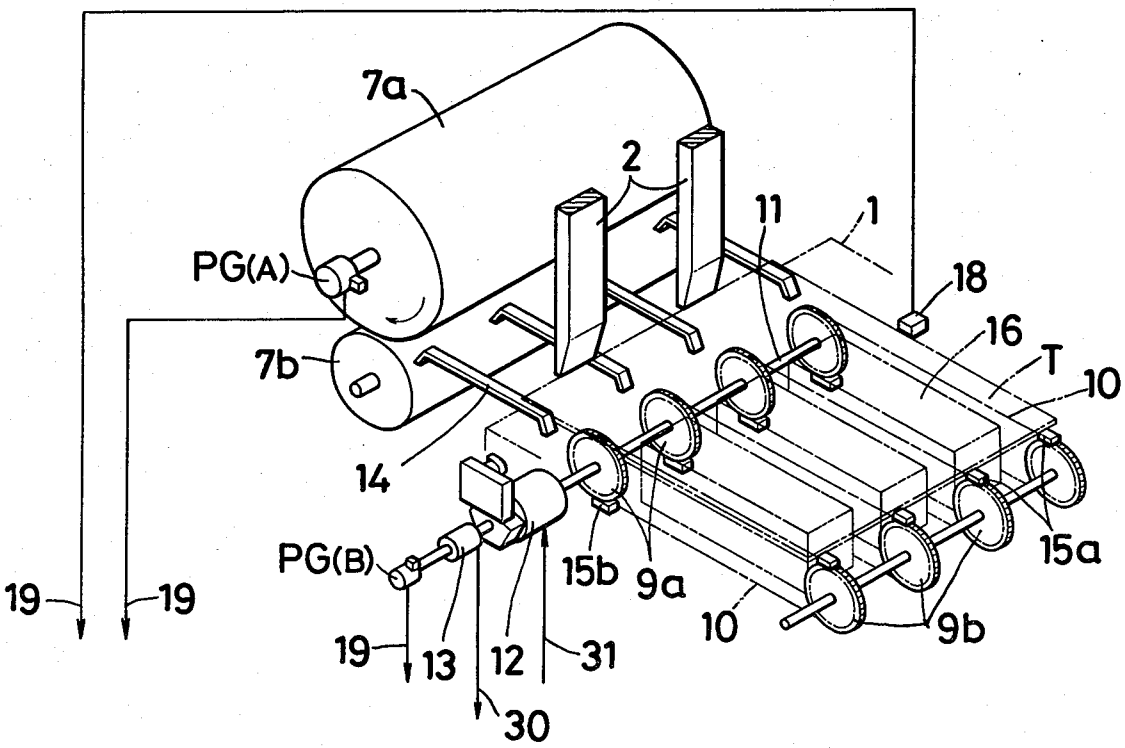
FIG. 3 is a perspective view thereof.

Referring to FIGS. 2 and 3 showing a preferred embodiment of this invention, an endless chain conveyor 10 passes around a pair of sprocket wheels 9*a* and 9*b* disposed under the table 1. A plurality of such chain conveyors are arranged side by side. The sprocket wheels 9*a* have a common driving shaft 11 to which a DC servomotor 12 is coupled through a speed reduction gear if necessary. Connected to the servomotor 12 are also a tachometer generator 13 and a pulse generator $PG_B$ for generating a pulse signal $\phi_B$ proportional to the distance the chain conveyors have run. Guide bars 14 are provided between the sprocket wheels 9*a* and the processing rolls 7*a* and 7*b* to support the blanks during transfer of the blanks to the rolls 7*a* and 7*b*. Another pulse generator $PG_A$ is provided on the shaft of the roll

7*a* to generate a pulse signal $\phi_A$ proportional to the distance the surface of the roll 7*a* has run.

Two kickers 15*a* and 15*b* for pushing the rear end of each blank are fixedly mounted on each conveyor chain at a distance from each other, said distance corresponding to a predetermined value $B_O$. A plurality of suction boxes 16 are provided under the table 1 to apply a suction force to each blank from below while it is conveyed on the chains. $L_O$ is a predetermined value corresponding to the circumference of the roll 7*a*. The length of each paperboard blank is equal to, or less than the circumference of the roll 7*a* except in special cases.

The processing rolls rotate at a predetermined speed in response to which the pulse generator $PG_A$ produces a pulse signal $\phi_A$. A sensor 18 is provided at one side of the table 1 adjacent to the sprocket wheels 9*a* to detect the arrival of the kicker 15*a* (or 15*b*) and to produce a signal indicating that the blank end has passed.

Figure 4:
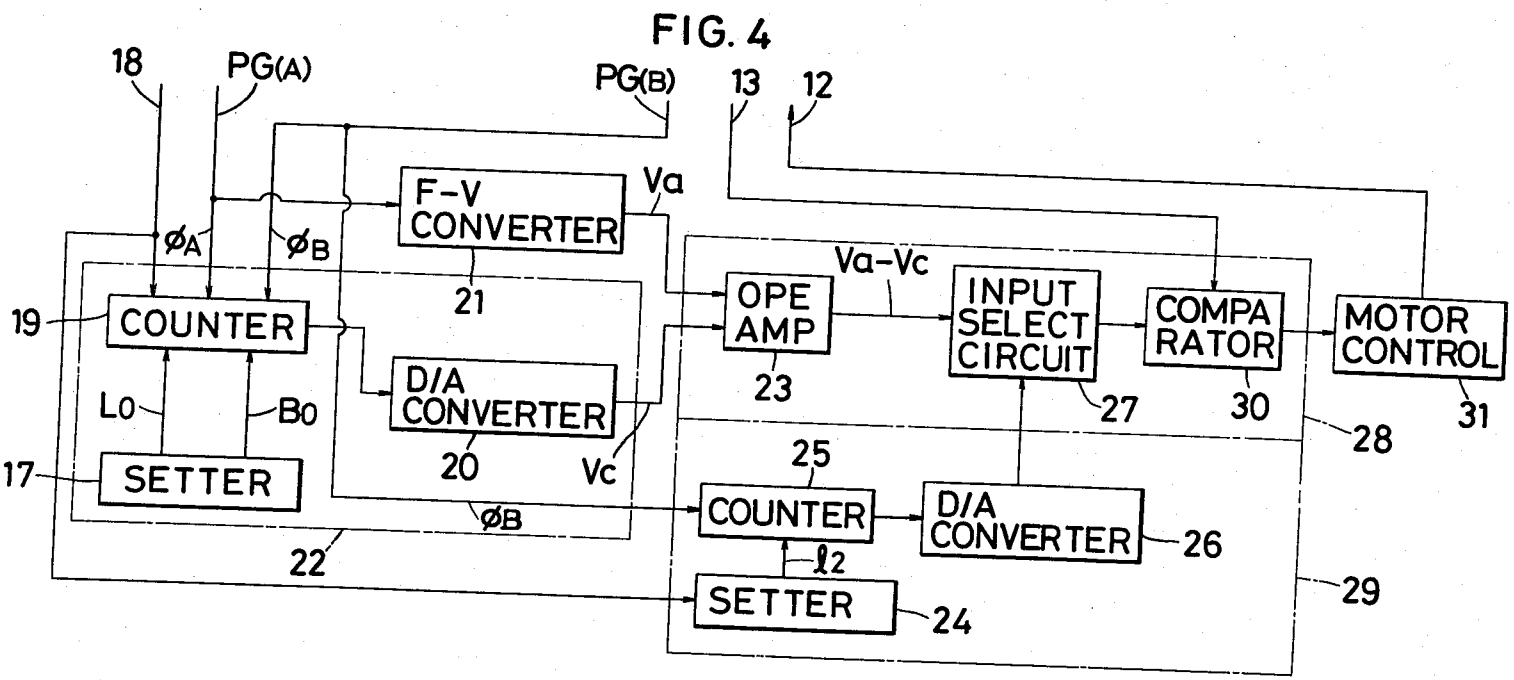
FIG. 4 is a block diagram of the control circuit thereof.

Referring to FIG. 4, a reversible counter 19 receives the predetermined values $L_O$ and $B_O$ from a setter 17, in response to a signal from sensor 18 and constantly receives the signal $\phi_A$ from the pulse generator $PG_A$ and the signal $\phi_B$ from the pulse generator $PG_B$ and makes the computation $L_O - B_O - \phi_A + \phi_B$. A digital-analog converter 20 converts the result of computation to an analog signal and outputs it as an error voltage $V_C$. The setter 17, counter 19 and D/A converter 20 constitute a computation control circuit 22. A frequency-voltage converter 21 receives the signal $\phi_A$ and converts it to a voltage $V_a$ proportional to the frequency of the signal. An operational amplifier 23 combines the error voltage $V_c$ from the digital-analog converter 20 with the voltage $V_a$ from the frequency-voltage converter 21.

In a setter 24 is set a predetermined value $l_2$ which corresponds to the distance from the position of the kicker when the sensor 18 operates to the position where the kicker stops. A reversible counter 25 subtracts the pulse signal $\phi_B$ from the pulse generator $PG_B$ from the preset value $l_2$ in response to the signal from the sensor 18. The digital output of the counter 25 is converted by a digital-analog converter 26 to an analog value.

An input select circuit 27 receives the signal from the operational amplifier 23 and the signal from the digital-analog converter 26 and outputs the larger of the two signals. The operational amplifier 23 and the input select circuit 27 constitute a speed command circuit 28 and the setter 24, the counter 25 and the digital-analog converter 26 constitute a stop control circuit 29. The speed command circuit 28 also includes a comparator 30 which compares the signal from the input select circuit 27 with the voltage fed back from the tachometer generator 13 to give a speed command signal proportional to the difference therebetween. A motor control means 31 receives the speed command signal and uses it to control the DC servomotor 12.

The operation of the apparatus according to the present invention will be described below. In FIG. 2, letter A designates the kicker start point where the kicker 15*a* engages the rear end of a blank T which is at a standstill. Letter B designates the position of the kicker when the leading end of the blank has just been nipped between the processing rolls. Letter C designates the position where the sensor 18 detects the kicker to operate and letter D designates the position where the kicker stops. The letter $l_1$ denotes the distance from point A to point B, and thus between the front guide and the center of the roll 7*a*, and $l_2$ the distance from point C to point D.

At first, the DC servomotor 12 stands still whereas the processing rolls 7a and 7b are rotating at a predetermined speed. When $(V_a-V_c)$ becomes larger than zero $(>0)$, the servomotor 12 starts to rotate. At the same time, the kicker 15a starts and travels at an accelerated speed as $(V_a-V_c)$ increases until the conveyor speed becomes equal to the peripheral speed of the processing rolls so that the error voltage $V_c$ becomes zero. During this period, the blank T is fed from point A to B through distance $l_1$. The blank travels at the same speed as the processing rolls from point B at the latest and maintains that speed since it has now been nipped by the rolls. During this period, the control circuit operates to keep $(L_o-B_o-\phi_A+\phi_B)$ zero by comparing the output of the speed command circuit with the voltage fed back from the tachometer generator 13 and inputting any difference to the motor control circuit 31. Thus, the kicker, too, runs at the same speed as the roll 7a.

When the kicker comes to point C and the sensor 18 detects it and provides a signal, $L_o-B_o-\phi_A+\phi_B$ (and thus the error voltage $V_c$) becomes larger than zero so that $(V_a-V_c)$ will be less than zero $(<0)$. On the other hand, in response to the signal from the sensor 18 the signal $l_2$ from the setter 24 will enter the counter 25 so that its output, $l_2-\phi_B$, will become larger than zero. Since $l_2-\phi_B$ is now larger than $(V_a-V_c)$, the input select circuit 27 will output the voltage from the digital-analog converter 26. As a result, the servomotor will be decelerated as $(l_2-\phi_B)$ decreases until the kicker stops at a predetermined point D. This completes one cycle of operation. Each time $(V_a-V_c)$ becomes larger than zero $(>0)$, the servomotor starts again and this cycle is repeated in a very short time.

The manner of control will be described in more detail with reference to FIGS. 5a and 5b which are speed vs. time diagrams.

First, referring to FIG. 5a, it will be assumed that the processing roll 7a is rotating at the maximum peripheral speed, $V_{a\ max}$. The pulse generator $PG_A$ produces a pulse signal $\phi_A$ corresponding to the speed. The kicker starts from point A and is accelerated at a predetermined rate $\alpha_1$ until its speed becomes equal to $V_{a\ max}$. Assuming that the time $t_1$ is required to bring the kicker speed just to the speed of the processing roll, the area of the triangle enclosed by points A, B and $t_1$ corresponds to the length $l_1$, through which the blank has traveled during that time.

After the sensor 18 has detected the kicker at point C at time $t_2$, the kicker is decelerated at a predetermined rate $\alpha_2$ until it stops at point D. It remains stopped for some time until it restarts at point A' in the next cycle. This completes one cycle, the period of which is $T_1$. Considering the object of this invention, $T_1$ is the time during which the roll 7a makes a full turn. The area of the triangle enclosed by C, D and $t_2$ corresponds to the distance $l_2$, through which the kicker has run from point C to D. Similarly, the area of a trapezoid defined by points A, B, C and D corresponds to the distance, $B_o$, through which the kicker has run from point A to D, that is, the distance through which it has run in one cycle. Also, since the roll 7a is rotating at a constant speed, $V_{a\ max}$, the distance covered by its surface in the period $T_1$, that is, the circumference, $L_o$, of the roll 7a is represented by the area of the rectangle defined by $V_{a\ max}$ and $T_1$.

FIG. 5b shows a similar diagram if the peripheral speed of the processing roll is reduced from $V_{a\ max}$ to $V_{a1}$. Since the rate of acceleration $\alpha_1$ is the same as in the above-mentioned case, the time required to tune the kicker speed to the roll speed is naturally shorter than $t_1$. Since the preset value, $L_o$, remains the same, the time $T_2$ taken for one cycle is longer than $T_1$ in the first case. Also, since the preset value $B_o$, too, is the same as before, the area of the trapezoid defined by A, $\beta$, $\gamma$, and D ($\beta$ is the time point when the kicker speed becomes equal to the roll speed and $\gamma$ is the time point when the kicker starts to be decelerated) will be the same as the area of the trapezoid defined by A, B, C and D in the first case. After the kicker speed has been tuned to the roll speed, the kicker passes point B at time $t'_1$. The kicker starts to be decelerated at the same predetermined rate $\alpha_2$ some time after it has passed point C at time $t'_2$. In this case, the area of the trapezoid defined by points A, $\beta$, B and $t'_1$ corresponds to $l_1$ and the area of the trapezoid defined by $t'_2$, C, $\gamma$ and D corresponds to $l_2$. Even if the roll speed is decreased from $V_{a\ max}$ to $V_{a1}$, the values $B_o$, $l_1$ and $l_2$ are fixed. The area of the rectangle determined by $V_{a1}$, A and A' represents the circumference $L_o$ of the processing roll 7a.

FIG. 6 illustrates the arrangement for shorter blanks than those in the previously-described case. In this arrangement, an assembly comprising the chain conveyors including kickers, sprocket wheels, suction boxes, sensor 18 and back guide 3 is moved as a unit forwardly or toward the processing roll. Since the distance $l_1$ from the front guide to the center of the processing roll is fixed, only the distance between the kicker start point A and the front guide has to be adjusted. The speed of the blank and thus of the kicker is controlled so as to be tuned to the roll speed just when or before the blank has run the distance $l_1$ and has been nipped by the processing rolls, and is decelerated at the time of or after the kicker passes the point C so that the kicker will stop precisely at point D.

It will be understood from the foregoing that the speed of the conveyor and thus of the kicker is electronically controlled with extreme precision so that it will be accelerated until the blank is nipped, be kept at the same speed as the roll speed from some time, and be decelerated upon the kicker passing the point C to stop the kicker at a predetermined position. This system eliminates feed rolls that would deform the corrugated layer. The chain conveyors are controlled so as to repeat the cycle including the acceleration→running at a constant speed→deceleration→stop, each cycle being completed in a very short time during which the processing roll makes a full turn.

Although a preferred embodiment has been described, it is to be understood that various changes and variations can be made without departing from the scope of the invention.

What is claimed is:

1. Apparatus for feeding blanks of paperboard or the like one after another from a stack of blanks to processing rolls, said apparatus comprising:

an endless conveyor means disposed under said stack of blanks for feeding blanks one after another from said stack to said processing rolls, at least one kicker means secured on said endless conveyor means for pushing the rear end of the blank at the bottom of said stack toward said processing rolls, motor means for driving said conveyor means, a first transducer means for generating pulses ($\phi_A$), the number thereof being proportional to the distance the surface of one of said processing rolls has rotated, a second transducer means for generating pulses ($\phi_B$), the number thereof being proportional to the distance the conveyor means has travelled, a sensor for detecting said kicker and giving a signal, a first setting means for setting a first value (Lo) determined by the circumference of said one of said processing rolls and a second value ($B_o$) determined by the distance the kicker travels during one cycle, a second setting means for setting a third value ($l_2$) determined by the distance the kicker travels during the time from the operation of said sensor to the stopping thereof, computation control means for receiving said first and second values and the pulses from said first transducer means and the pulses from said second transducer means and performing a computation expressed by ($Lo-Bo-\phi_A+\phi_B$), to determine an error signal, combining means for combining together said error signal and a voltage proportional to the signal from said first transducer means, stop control means responsive to the signal from said sensor for subtracting the pulses from said second transducer from said third value, means for selecting the higher one from the two signals, that from said combining means and that from said stop control means, and comparing it with a voltage proportional to the speed of the conveyor means and producing a speed command signal proportional to the difference therebetween, and motor control means for receiving said speed command signal to control said motor means so that one cycle of kicker operation will be completed while said one of said processing rolls makes a full turn, said one cycle including the acceleration, tuned-run and deceleration periods.

* * * * *